US008120544B2

(12) United States Patent
Sauer

(10) Patent No.: US 8,120,544 B2
(45) Date of Patent: Feb. 21, 2012

(54) COMPACT CONTINUOUS GROUND PLANE SYSTEM

(75) Inventor: Rohn Sauer, Encino, CA (US)

(73) Assignee: Raytheon Company, Waltham, MA (US)

( * ) Notice: Subject to any disclaimer, the term of this patent is extended or adjusted under 35 U.S.C. 154(b) by 324 days.

(21) Appl. No.: 12/391,979

(22) Filed: Feb. 24, 2009

(65) Prior Publication Data

US 2010/0212145 A1 Aug. 26, 2010

(51) Int. Cl.
*H01Q 1/48* (2006.01)

(52) U.S. Cl. ..... 343/846; 343/848; 343/906; 439/2; 439/12; 439/111; 439/386; 439/916

(58) Field of Classification Search ..... 343/705, 343/718, 846, 848, 875, 877, 915, 901, 903, 343/906; 439/2, 6, 12, 111, 120, 916, 386
See application file for complete search history.

(56) References Cited

U.S. PATENT DOCUMENTS

| | | | | |
|---|---|---|---|---|
| 3,541,566 | A * | 11/1970 | Riebsamen | 343/882 |
| 5,063,389 | A * | 11/1991 | Reits | 342/359 |
| 5,133,676 | A * | 7/1992 | Hutchison et al. | 439/581 |
| 5,299,939 | A * | 4/1994 | Walker et al. | 439/74 |
| 5,625,367 | A * | 4/1997 | Unwin | 343/745 |
| 6,100,855 | A | 8/2000 | Vinson et al. | |
| 6,366,259 | B1 | 4/2002 | Pruett et al. | |
| 6,533,593 | B1 * | 3/2003 | Ishii | 439/188 |
| 6,680,698 | B2 | 1/2004 | Eiges | |
| 6,825,812 | B2 * | 11/2004 | Yokota et al. | 343/713 |
| 7,132,990 | B2 | 11/2006 | Stenger et al. | |
| 7,348,932 | B1 | 3/2008 | Puzella et al. | |
| 7,391,382 | B1 | 6/2008 | Mason et al. | |
| 2002/0191384 | A1 | 12/2002 | Wei | |
| 2005/0118364 | A1 * | 6/2005 | Guise et al. | 428/34.1 |
| 2006/0109178 | A1 * | 5/2006 | Takeuchi et al. | 343/700 MS |
| 2008/0204350 | A1 | 8/2008 | Tam et al. | |

FOREIGN PATENT DOCUMENTS

| | | | |
|---|---|---|---|
| DE | 29 17 880 | A1 | 2/1980 |
| DE | 102 05 816 | A1 | 8/2003 |

OTHER PUBLICATIONS

Chomerics—Shielding Methods; http://www.chomerics.com/tech/Shielding_methods.htm; dated Nov. 25, 2008; 6 pages.

Extended European Search Report for European Application No. 10250321.6, filed Feb. 24, 2010, Extended European Search Report dated Jun. 24, 2010 and mailed Jul. 5, 2010 (6 pgs.).

Spira™ Groove Mounting Techniques; http://www.spira-emi.com; downloaded Nov. 26, 2008; pp. 47-51.

Sprira Manufacturing—EMI Shielding Theory; http://www.spira-emi.com/mainpages/theory_main htm; downloaded Nov. 26, 2008; 5 pages.

* cited by examiner

*Primary Examiner* — Jacob Y Choi
*Assistant Examiner* — Shawn Buchanan
(74) *Attorney, Agent, or Firm* — Christie, Parker & Hale, LLP

(57) ABSTRACT

A compact continuous ground plane system is provided. In one embodiment, the invention relates to an assembly for forming a continuous ground plane for an antenna having at least two elements configured to move relative to one another, the ground assembly including a first element having a housing, a plunger disposed within the housing, a second element, a wear plate coupled to the second element, and a spring disposed between the plunger and the housing, the spring configured to urge the plunger toward the wear plate, where the plunger is configured to be moved within the housing and to make electrical contact with the wear plate.

22 Claims, 7 Drawing Sheets

(Section A-A)

COMPACT CONTINUOUS GROUND PLANE SYSTEM

STATEMENT REGARDING FEDERALLY SPONSORED RESEARCH OR DEVELOPMENT

This work was sponsored under Department of Defense Contract No. F19628-00-C -0100-MP-RTIP, and subcontract A140000084-MP-RTIP. The government has certain rights in this invention.

FIELD OF THE INVENTION

The present invention relates generally to grounding systems. More specifically, the invention relates to a grounding system that provides for a continuous ground plane between components that move relative to one another.

BACKGROUND

A good ground plane is essential to proper operation of a number of antenna systems. Active array antennas in particular have a need for a continuous ground plane. Without such a ground plane, undesirable effects can disrupt received signals and impair antenna performance. The importance of ground planes for antennas is described in U.S. Pat. No. 6,100,855 to Vinson, et al., the entire content of which is expressly incorporated herein by reference.

Antenna systems can include a number of radiating elements. Examples of antenna systems can be found in U.S. Pat. No. 6,366,259 to Pruett et al. and U.S. Pat. No. 7,391,382 to Mason et al., the entire content of each is expressly incorporated herein by reference. The radiating elements can send and receive signals provided by way of a main feed network. Often, the radiating elements are mounted such that a small space, such as a gap, exists between the elements. In some applications, the antenna systems are mounted to moving devices, such as aircraft or other vehicles. In such case, the radiating elements can be exposed to significant vibration. Both the gaps in antenna structure and the vibration create challenges to implementing and maintaining a continuous ground plane for an antenna system.

Systems to account for vibration and/or gaps in a ground plane have been proposed. These systems include, for example, copper fingers, spiral gaskets, and metallized tape. Among other limitations, such systems are unable to provide a continuous ground plane for antennas having relative movement between radiating elements.

SUMMARY OF THE INVENTION

Aspects of the invention relate to a compact continuous ground plane system. In one embodiment, the invention relates to an assembly for forming a continuous ground plane for an antenna having at least two elements configured to move relative to one another, the ground assembly including a first element having a housing, a plunger disposed within the housing, a second element, a wear plate coupled to the second element, and a spring disposed between the plunger and the housing, the spring configured to urge the plunger toward the wear plate, where the plunger is configured to be moved within the housing and to make electrical contact with the wear plate.

DETAILED DESCRIPTION OF THE INVENTION

Figure 1:
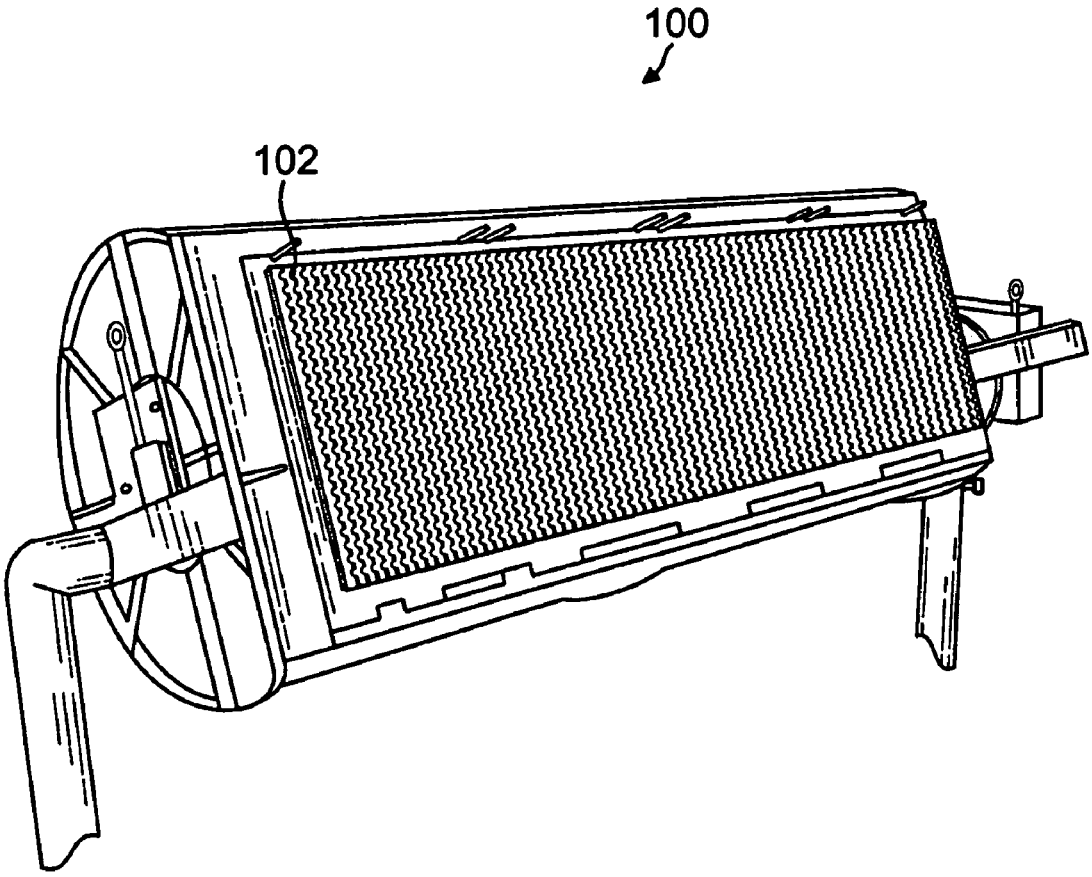
FIG. 1 is an isometric view of a antenna system having multiple radiating elements in accordance with one embodiment of the present invention.

Referring now to the drawings, embodiments of assemblies for forming continuous ground planes are illustrated. In many embodiments, the grounding assemblies include a plunger, a spring, a retaining housing and a wear plate for electrically coupling adjacent radiating elements to one another despite relative movement. The plunger can have a T-shaped "dove tail" end and a tapered end with a rounded contact point to minimize wear on the wear plate. The "dove tail" end can be retained within the retaining housing.

The spring can be a wavy spring mounted between the plunger and the retaining housing such that the spring provides a force to the plunger directed away from the radiating element. The retaining housing is mounted to a radiating element. The wear plate is mounted to an adjacent radiating element and configured to make contact with the plunger. The assembly can sustain electrical contact between the radiating elements despite a predetermined amount of relative motion between the radiating elements. In some cases, the relative motion can be caused by vibration. In several embodiments, the relative motion is caused when the radiating elements are part of an antenna that is mounted to a moving vehicle, such as an aircraft. In a number of embodiments, the relative motion can occur in different directions. In many embodiments, the ground plane assemblies are configured to sustain electrical contact despite the relative motion in different directions.

FIG. 1 is an isometric view of a antenna system 100 having multiple radiating elements 102 in accordance with one embodiment of the present invention. In the illustrated embodiment, the multiple radiating elements 102 are disposed vertically and adjacent to one another in an array architecture. In one embodiment, the antenna system can be an active electronically scanned array (AESA). In some embodiments, the antenna system can be used with an aircraft such as a military jet. In several embodiments, the antenna system is a component of a radar system for tracking objects, terrain, weather and a speed of the objects. In some embodiments, the antenna system can be used with other vehicles such as a ship. In one embodiment, the antenna system is used with a stationary system.

Figure 2:
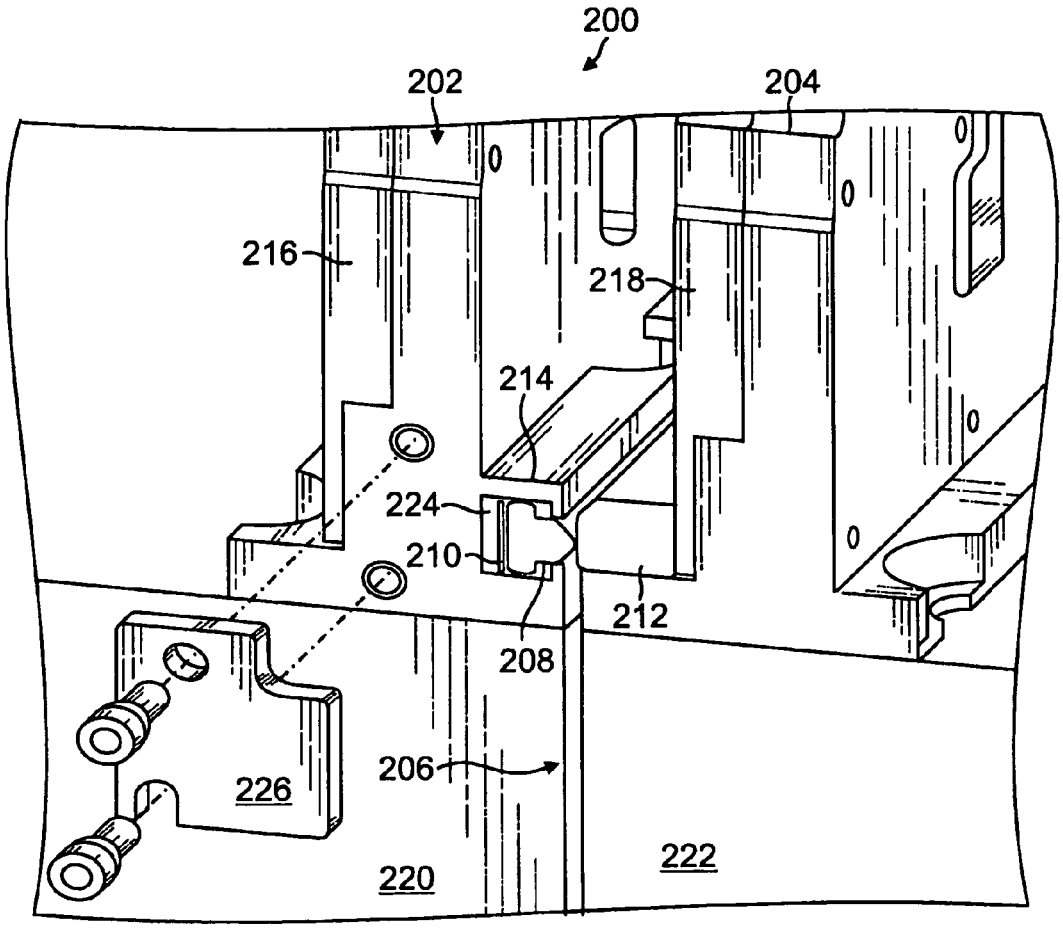
FIG. 2 is a fragmentary isometric view of base sections of adjacent radiating elements of an antenna system and an assembly, including a plunger, a wear plate, a retaining housing and a spring, for forming a ground plane between the adjacent radiating elements in accordance with one embodiment of the present invention.

FIG. 2 is a fragmentary isometric view of base sections of adjacent radiating elements of an antenna system and an assembly, including a plunger, a wear plate, a retaining housing and a spring, for forming a ground plane between the adjacent radiating elements in accordance with one embodiment of the present invention. The antenna system 200 includes a base portion of a first radiating element 202 and a base portion of a second radiating element 204 separated by a gap 206. The radiating elements are electrically coupled by a grounding assembly. The grounding assembly includes a plunger 208, a spring 210, a wear plate 212 and a retaining housing 214. The plunger 208 and spring 210 are disposed within the rectangular retaining housing 214 of the first radiating element 202. The plunger 208 has a T-shaped "dove tail" end 208*a* that is retained within a cavity 224 formed by the retaining housing 214.

A first housing 216 is coupled to a side of the first radiating element 202. Similarly, a second housing 218 is coupled to a side of the second radiating element 204. The first radiating element 202 is mounted to a first antenna support structure 220, and the second radiating element 204 is mounted to a second antenna support structure 222. In most embodiments, the second antenna support structure has a chamfer disposed along a lower edge of the structure (not visible) and the gap 206.

Figure 3:
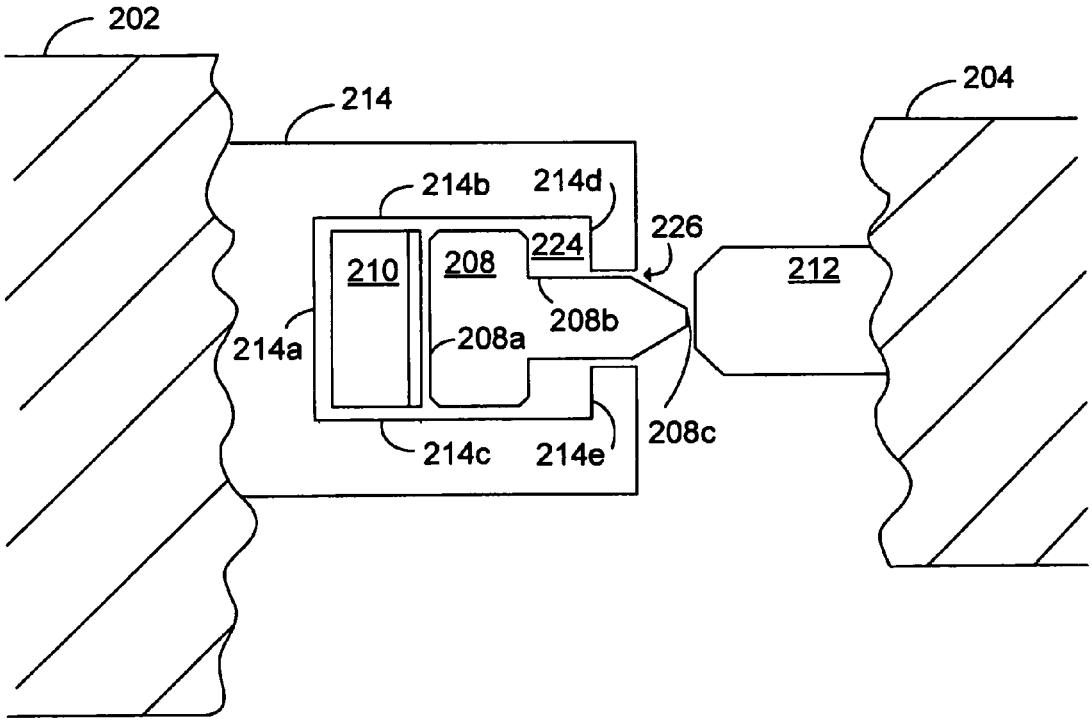
FIG. 3 is an enlarged side view of the grounding assembly of FIG. 2.

FIG. 3 is an enlarged side view of the grounding assembly of FIG. 2. The retaining housing 214 includes a rear wall 214*a*, a top wall 214*b*, a bottom wall 214*c*, a top retaining wall 214*d*, and a bottom retaining wall 214*e* which form the retaining cavity 224. The top retaining wall 214*d* and bottom retaining wall 214*e* are disposed on the top and bottom, respectively, of an opening 226 through which a shaft 208*b* of the plunger 208 can be moved. The shaft 208*b* and head 208*a* are disposed below the top wall 214*b* and above the bottom wall 214*c* within the cavity 224. The spring 210 is disposed between a flat rear surface of the head 208*a* and the rear wall 214*a* of the retaining cavity 224.

When compressed, the spring 210 is configured to provide a force on the plunger 208 directed away from the first radiating element 202 and toward the adjacent second radiating element 204. In effect, the spring 210 can urge the plunger toward the wear plate 212. The plunger 208 can move laterally within the retaining housing 214 for a distance limited by the width of the cavity within the housing 214 and the width of the spring 210 in a compressed state. The spring 210 resists movement of the plunger 208 toward the first radiating element 202. In one embodiment, such movement can be caused by a vibrational force applied to the grounding assembly.

In some embodiments, the spring 210 is a wavy spring having a number of wave-like bends in a thin flat metallic material. In one embodiment, the spring 210 is made of tin plated steel. In other embodiments, the spring is made of other suitably conductive and compression resistant materials. In one embodiment, the spring is made of a non-conductive material. In such case, an alternate means of making an electrical connection between the plunger and the first radiating element can be used. In one embodiment, the alternate means includes one or more wires coupling the retaining housing and the plunger.

In some embodiments, the spring is a leaf spring. In several embodiments, the spring has an elongated body that extends approximately the length of the first radiating element. In other embodiments, the spring may be replaced by a number of discrete springs having a similar structure in a shorter form factor. In one embodiment, the spring can be replaced with a number of coil springs.

In the exploded side view of FIG. 3, the plunger 208 features a cross section having a T-shape (e.g., like a short nail) resting horizontally within the retaining housing 214. As depicted in FIG. 3, the T-shape includes a rectangular head 208*a*, positioned such that the longer sides are disposed vertically within the cavity 224, and a pointed shaft 208*b* disposed horizontally. The end of the shaft is chamfered and comes to a beveled or rounded point 208*c*. In many embodiments, the beveled point (or blunt end) 208*c* of the plunger 208 makes contact with the wear plate 212 in an assembled configuration. In many embodiments, head portion 208*a* of the plunger makes electrical contact with the retaining housing, by both direct physical contact and indirectly by way of the spring 210.

In some embodiments, the plunger is made of aluminum. In several embodiments, the plunger is plated with a material including both nickel and chrome. In such case, the material is conducive to establishing good electrical continuity between the plunger and those objects that come in contact with the plunger. In other embodiments, the plunger is made of other conductive materials and/or coated with other conductive materials. In some embodiments, the plunger is hollow. In many embodiments, the plunger has an elongated body that extends approximately the length of the first radiating element. In some embodiments, a number of discrete plungers can be used that are shorter in length than the first radiating element. In other embodiments, the plunger can take other shapes providing for constant electrical contact with the wear plate.

In the embodiment illustrated in FIGS. 2 and 3, the wear plate 212 has a rectangular cross section with a beveled front corner. A front surface of the wear plate 212 faces the plunger 208 and is configured to make contact with the beveled or rounded point of the plunger 208. In several embodiments, the flat front surface of the wear plate allows for relative motion between in the radiating elements in a vertical direction (e.g., up and down motion). The wear plate 212 extends longitudinally for approximately the length of the second radiating element 204. In some embodiments, a number of discrete wear plates can be used instead of a single elongated wear plate. In many embodiments, the wear plate is made of aluminum and is plated with nickel. In some embodiments, the wear plate is made and/or coated with other conductive materials. In several embodiments, the wear plate is hollow. In the embodiment illustrated in FIGS. 2 and 3, the wear plate has a rectangular cross section with a beveled corner. In other embodiments, the wear plate can take other shapes suitable for providing electrical connectivity between adjacent radiating elements.

In several embodiments, the materials for the wear plate, the plunger and their respective coating materials are selected to prevent galling. Galling can be thought of as a condition where excessive friction between high spots results in localized welding with subsequent splitting and a further roughening of rubbing surfaces of one or both of two mating parts. In practice, galling can be caused when the same materials come in contact with one another on the adjacent mating parts. To prevent galling, embodiments of the grounding assembly can avoid using common metals for mating parts (e.g., plunger and wear plate). In the embodiment illustrated in FIG. 2, for example, the plunger can be made of a core metal that is chrome plated, while the wear plate is made of nickel plated aluminum. In such case, the metals in contact with one another are chrome and nickel, and galling between components having substantial contact is prevented. In this case, the prevention of galling can allow mating parts (e.g., the plunger and the wear plate) to move smoothly relative to one another for a longer period of time than they would if no steps to prevent galling were taken.

Returning to FIG. 2, a plunger cover plate 226 can be fastened by two mounting bolts to secure ends of the spring 210 and the plunger 208 within the retaining housing 214. In many embodiments, a similar cover plate is fastened to the opposite side of the first radiating element.

In some embodiments, the radiating elements and coupled housings are made of hollow aluminum. In several embodiments, the antenna support structures are made of hollow aluminum. In other embodiments, other suitable materials can be used for the radiating elements, the plunger, the spring, and the wear plate.

In a number of embodiments, the components of the grounding assembly effectively provide self-contained connection systems and thus the final antenna system can be assembled and unassembled easily as opposed to antenna systems using prior art technologies (e.g., conductive tapes or gaskets). In one embodiment, for example, the components of the grounding assembly include the plunger in its retaining housing fully installed on the first radiating element and the wear plate fully installed on the second radiating element. In such case, after components of the grounding assembly have been fully assembled on the first radiating element and second radiating elements, the radiating elements can be installed on the antenna system by placing the first radiating element into a first slot and by sliding the second radiating element into an adjacent slot on the antenna system while allowing the plunger to retract whereby an elongated point of contact between the plunger and wear plate is achieved. In one embodiment, the first radiating element and second radiating elements are components of a first antenna assembly and a second antenna assembly, respectively, where each assembly includes components in addition to the radiating elements.

In a number of embodiments, the final assembly step for the antenna system therefore requires no tools and the system can be uninstalled just as easily without tools. Prior art systems, on the other hand, such as those using conductive tapes, gaskets, and the like are generally not capable of being easily uninstalled and reinstalled. For example, prior art technologies such as copper finger gaskets, conductive plates or the like can require one or more fasteners for installation of the grounding assembly. In such case, additional time and tools are required for installation, disassembly and any subsequent reassembly of the grounding system or antenna.

Figure 4:
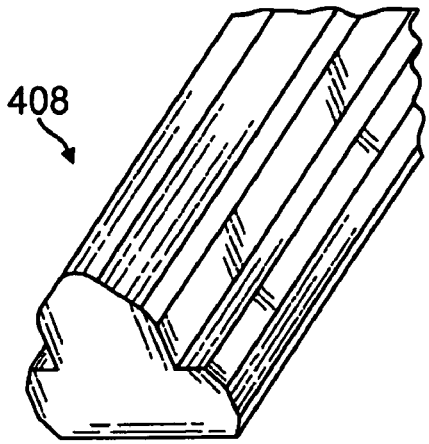
FIG. 4 is an isometric view of one end of a plunger in accordance with one embodiment of the present invention.

FIG. 4 is an isometric view of one end of a plunger 408 in accordance with one embodiment of the present invention. The plunger 408 features a cross section having a T-shaped body including a head and a relatively wide shaft extending from the head and coming to a beveled point. The head has a rectangular shape where each corner of the rectangle has been chamfered at roughly 30 degrees from the surfaces of the shorter sides (e.g., top and bottom) of the rectangle. The shaft extends from the head for a predetermined distance until it is chamfered at approximately 45 degrees. The chamfered portion of the shaft comes to a beveled point. The end points of the 45 degree chamfered surface are beveled as well. In other embodiments, more edges and corners can be chamfered and/or rounded for best fit and function. Chamfering and rounding can enable smooth movement within an opening of a retaining housing and can enable good electrical contact with a wear plate.

Figure 5:
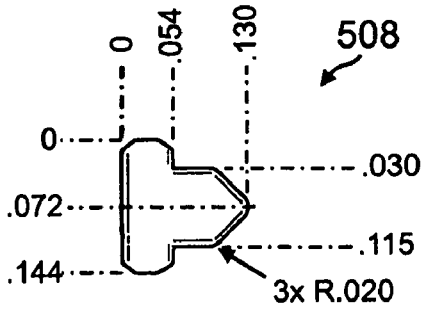
FIG. 5 is a end view of a plunger in accordance with one embodiment of the present invention.
Figure 6:
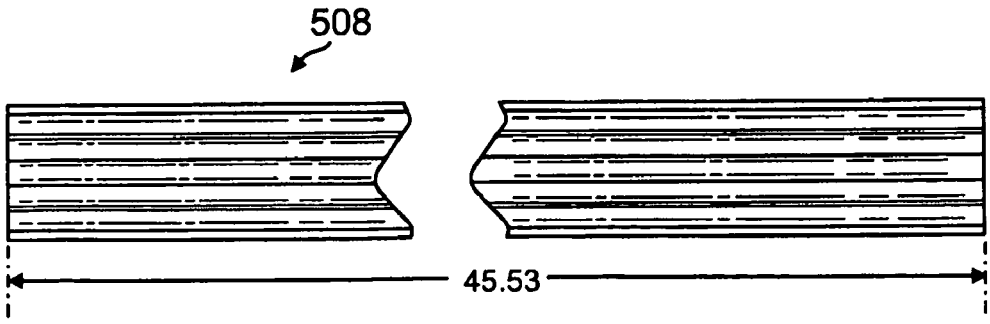
FIG. 6 is a side view of the plunger of FIG. 5.

FIG. 5 is an end view of a plunger 508 in accordance with one embodiment of the present invention. In the embodiment illustrated in FIG. 5, the head of the plunger 508 has a width of 0.054 inches and a length of 0.144 inches. The shaft can have a width, from top to bottom, of 0.085 inches. The shaft can have a length of 0.076 inches extending from the head to the beveled point at the end of the shaft. The head can have a length, from top to bottom, of 0.144 inches. Thus, in a number of embodiments, the length of the head is greater than the width of the shaft. FIG. 6 is a side view of the plunger 508 of FIG. 5.

Figure 7:
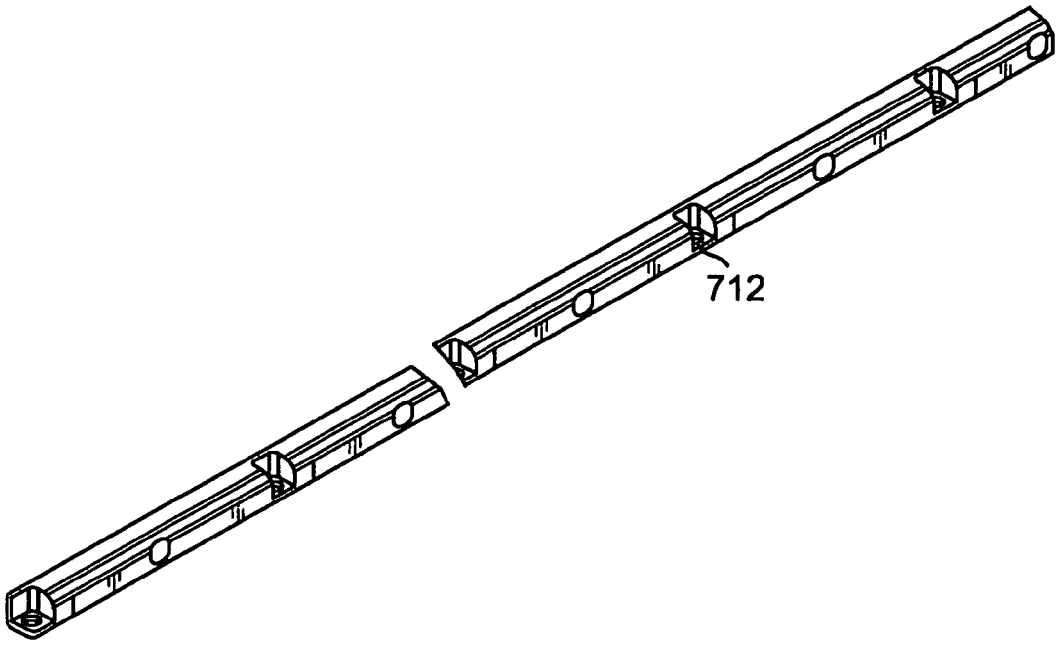
FIG. 7 is an isometric view of a wear plate in accordance with one embodiment of the present invention.
Figure 8:
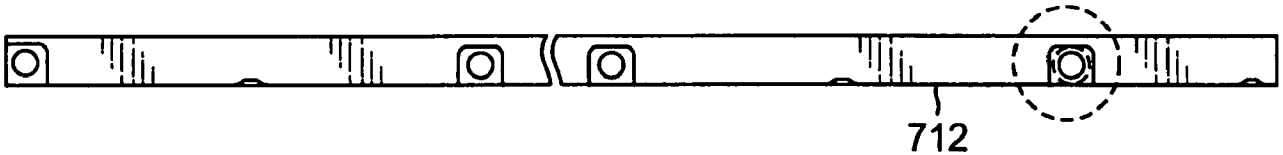
FIG. 8 is a top view of the wear plate of FIG. 7.
Figure 9:
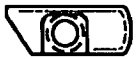
FIG. 9 is an enlarged view of a mounting hole of the wear plate of FIG. 7.
Figure 10:
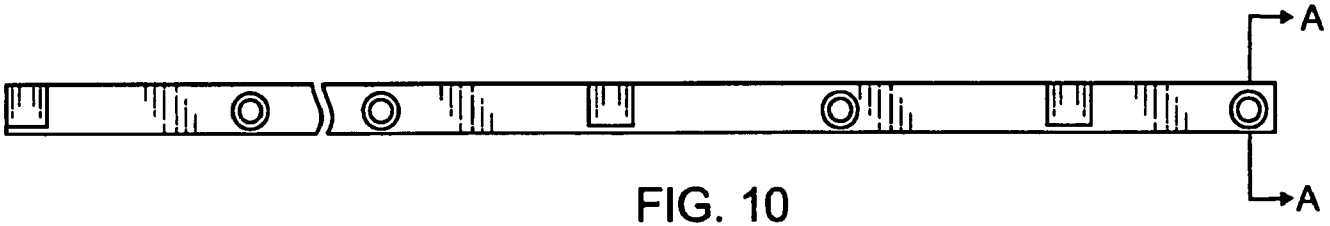
FIG. 10 is a side view of the wear plate of FIG. 7.
Figure 11:
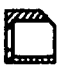
FIG. 11 is a cross sectional view of the wear plate of FIG. 10 taken across the section A-A.

FIG. 7 is an isometric view of a wear plate 712 in accordance with one embodiment of the present invention. In a number of embodiments, the wear plate is a solid bar having a number of recesses for mounting. In other embodiments, the wear plate can be a hollow bar. FIG. 8 is a top view of the wear plate 712 of FIG. 7. FIG. 9 is an enlarged view of a mounting hole of the wear plate of FIG. 7. FIG. 10 is a side view of the wear plate 712 of FIG. 7. The wear plate 712 includes a number of mounting holes for attaching the wear plate to a radiating element. FIG. 11 is a cross sectional view of a section of the wear plate 712 of FIG. 10 taken across the section A-A. In the embodiment illustrated in FIG. 11, the wear plate 712 is hollowed at the mounting hole to accommodate a mounting fastener (not shown). The upper front corner of the wear plate 712 is chamfered at approximately 45 degrees. The end points of the chamfered surface on the corner of the wear plate are rounded. In other embodiments, other surfaces can be beveled and/or rounding to improve fit and function for making ground plane contact. In the embodiment illustrated in FIGS. 7-11, the wear plate is a single elongated unit. In other embodiments, the wear plate includes multiple discrete units performing a similar function. In some embodiments, the wear plate can take any number of shapes suitable for providing electrical connectivity between adjacent radiating elements.

Figure 12:
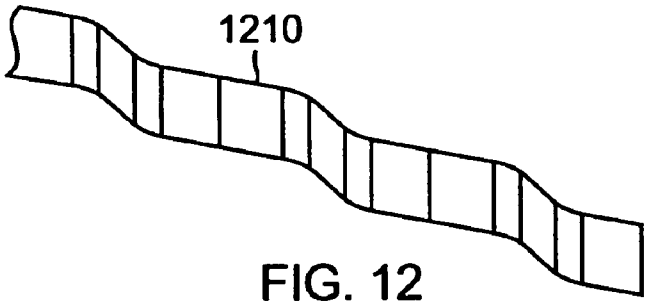
FIG. 12 is an isometric view of a wavy portion of a spring in accordance with one embodiment of the present invention.

FIG. 12 is an isometric view of a wavy portion of a spring 1210 in accordance with one embodiment of the present invention. The spring includes a number of sections bent at a small angle where the apex of adjacent bends is rounded or beveled. The resulting shape is wavy and resists compression by opposing flat surfaces.

Figure 13:
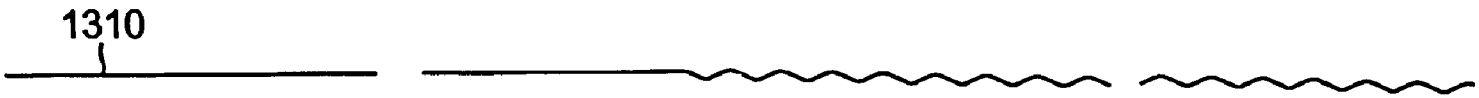
FIG. 13 is a top view of a spring having both a flat portion and a wavy portion in accordance with one embodiment of the present invention.

FIG. 13 is a top view of a spring 1310 having both a flat portion and a wavy portion in accordance with one embodiment of the present invention. In many embodiments, the spring 1310 can be used in conjunction with the grounding assembly of FIG. 2. In such case, the plunger can be inserted into the retaining housing first. After the plunger has been inserted, the flat portion of the spring 1310 can be inserted into the retaining housing in the empty space behind the plunger. In such case, once the flat portion has been inserted into one side of the retaining housing, the flat portion can be pulled out of the other side and then severed from the remaining wavy portion of the spring. In such case, the only the wavy portion of the spring 1310 remains in the retaining housing. This two part spring structure and method of insertion can minimize difficulty associated with installation of the spring within the grounding assembly.

Figure 14:
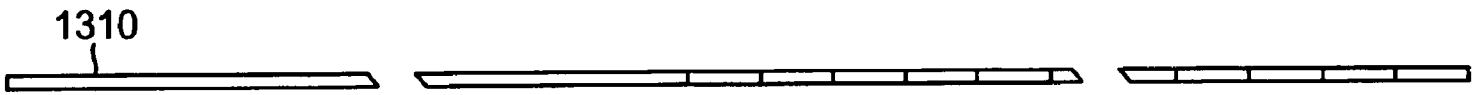
FIG. 14 is a side view of the spring of FIG. 13.

FIG. 14 is a side view of the wavy spring 1310 of FIG. 13.

Proper grounding can also be important in dealing with electromagnetic interference (EMI) problems. Electromagnetic interference, or radio frequency interference (or RFI), is generally defined as an unwanted disturbance that affects an electrical circuit due to electromagnetic radiation emitted from an external source. The disturbance can interrupt, obstruct, or otherwise limit the effective performance of the electrical circuit. The source can be any object that carries rapidly changing electrical currents, such as an electrical circuit. In certain circumstances, an antenna transmitting and receiving signals at a relatively fast rate is such an electrical circuit and can be a troublesome source of EMI.

Improper grounding can be a primary means of noise coupling and other interference. The embodiments of grounding assemblies described herein are useful for preventing the unintended radiation of signals that would effectively become EMI. In systems demonstrating EMI problems, the grounding assemblies described herein can be used to minimize such EMI, especially in circumstances where the specific components responsible for EMI generation move relative to one another.

While the above description contains many specific embodiments of the invention, these should not be construed as limitations on the scope of the invention, but rather as examples of specific embodiments thereof. Accordingly, the scope of the invention should be determined not by the embodiments illustrated, but by the appended claims and their equivalents.

What is claimed is:

1. An assembly for forming a continuous ground plane for an antenna having at least two radiating elements configured to move relative to one another, the ground assembly comprising:

a first radiating element having a housing;

a plunger disposed within the housing;

a second radiating element configured to move relative to the first radiating element;

a wear plate coupled to the second element; and a spring disposed between, and in contact with, the plunger and the housing, wherein the spring is configured to urge the plunger toward the wear plate;

wherein the plunger is configured to be moved within the housing, to extend through an opening in the housing, and to make electrical contact with the wear plate.

2. The assembly of claim 1, wherein the spring is configured to maintain the electrical contact between the plunger and the wear plate.

3. The assembly of claim 1, wherein the first element and the second element are separated by a gap.

4. An assembly for forming a continuous ground plane for an antenna having at least two radiating elements configured to move relative to one another, the ground assembly comprising:

a first radiating element having a housing;

a plunger disposed within the housing;

a second radiating element;

a wear plate coupled to the second element; and a spring disposed between, and in contact with, the plunger and the housing, wherein the spring is configured to urge the plunger toward the wear plate;

wherein the plunger is configured to be moved within the housing and to make electrical contact with the wear plate;

wherein the housing comprises a rectangular cavity having an opening and retaining walls;

wherein the plunger comprises a T-shaped cross section having a shaft portion and a head portion, wherein a length of the head portion is greater than a width of the shaft portion;

wherein the shaft portion is configured to be moved through the opening;

wherein the retaining walls are configured to prevent movement of the plunger beyond a predetermined distance within the cavity; and wherein the shaft portion comprises a tapered blunt end.

5. The assembly of claim 4, wherein the plunger is elongated in a direction normal to the T-shaped cross section.

6. The assembly of claim 4:

wherein the shaft portion is chamfered from the tapered blunt end to sides of the shaft portion; and wherein the tapered blunt end is chamfered along a direction perpendicular to the shaft.

7. The assembly of claim 4:

wherein the shaft portion is chamfered from the tapered blunt end to sides of the shaft portion; and wherein the tapered blunt end is rounded.

8. The assembly of claim 1, wherein the spring comprises a wavy spring.

9. The assembly of claim 8, wherein the wavy spring comprises an elongated thin sheet of metal having a plurality of bends.

10. The assembly of claim 1:

wherein the wear plate comprises a rectangular cross section;

wherein the wear plate is elongated in a direction normal to the rectangular cross section; and wherein the wear plate comprises a front surface configured to make electrical contact with the plunger.

11. The assembly of claim 10, wherein the rectangular cross section is chamfered at a corner of the rectangular cross section.

12. The assembly of claim 1, wherein the plunger and the wear plate are comprised of materials to prevent galling.

13. The assembly of claim 1, wherein the plunger is comprised of aluminum and plated with a material comprising chrome and nickel.

14. The assembly of claim 1, wherein the spring is comprised of steel and plated with tin.

15. The assembly of claim 1, wherein the wear plate is comprised of aluminum and plated with nickel.

16. The assembly of claim 1:

wherein the first element and the housing are comprised of aluminum; and wherein the first element is hollow.

17. The assembly of claim 1:

wherein the second element is comprised of aluminum.

18. The assembly of claim 1:

wherein the first element is a radiating element for an antenna; and wherein the second element is a radiating element for an antenna and is adjacent to the first element.

19. The assembly of claim 1:

wherein the plunger is configured to be inserted into the housing;

wherein the spring comprises a flat portion and a wavy portion;

wherein the flat portion of the spring is configured to be inserted into a cavity between a wall of the housing and a surface of the plunger;

wherein the flat portion of the spring is configured to be removed from the housing while the wavy portion remains substantially within the housing; and wherein the flat portion of the spring is configured to be severed from the wavy portion and removed from the assembly.

20. The assembly of claim 1, wherein the first radiating element is configured to move relative to the second radiating element.

21. The assembly of claim 1, wherein the plunger and the wear plate are configured to form the continuous ground plane for the antenna.

22. An assembly for forming a continuous ground plane for an antenna having at least two radiating elements configured to move relative to one another, the ground assembly comprising:

a first radiating element having a housing;

a plunger disposed within the housing, the plunger comprising a T-shaped cross section having a shaft portion and a head portion, wherein a length of the head portion is greater than a width of the shaft portion;

a second radiating element configured to move relative to the first radiating element;

a wear plate coupled to the second element; and a spring disposed between, and in contact with, the plunger and the housing, wherein the spring is configured to urge the plunger toward the wear plate;

wherein the plunger is configured to be moved within the housing, to extend through an opening in the housing, and to make electrical contact with the wear plate.

* * * * *